US010074525B2

(12) United States Patent
Collings et al.

(10) Patent No.: US 10,074,525 B2
(45) Date of Patent: Sep. 11, 2018

(54) FLOW THROUGH MS$^3$ FOR IMPROVED SELECTIVITY

(71) Applicant: DH Technologies Development Pte. Ltd., Singapore (SG)

(72) Inventors: Bruce Andrew Collings, Bradford (CA); Bruce A. Thomson, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/026,240

(22) PCT Filed: Oct. 7, 2014

(86) PCT No.: PCT/IB2014/002043

§ 371 (c)(1),
(2) Date: Mar. 30, 2016

(87) PCT Pub. No.: WO2015/068002

PCT Pub. Date: May 14, 2015

(65) Prior Publication Data

US 2016/0240360 A1 Aug. 18, 2016

Related U.S. Application Data

(60) Provisional application No. 61/901,096, filed on Nov. 7, 2013.

(51) Int. Cl.
*H01J 49/00* (2006.01)
*H01J 49/04* (2006.01)
(Continued)

(52) U.S. Cl.
CPC ..... *H01J 49/0045* (2013.01); *H01J 49/0063* (2013.01); *H01J 49/04* (2013.01);
(Continued)

(58) Field of Classification Search
USPC ..... 250/283
See application file for complete search history.

(56) References Cited

U.S. PATENT DOCUMENTS 5,274,233 A 12/1993 Kelley
6,525,312 B1 2/2003 Cousins
(Continued)

FOREIGN PATENT DOCUMENTS

GB 2429579 A 2/2007
WO 200033350 A2 6/2000
(Continued)

OTHER PUBLICATIONS

International Search Report and Written Opinion for PCT/IB2014/002043, dated Jan. 28, 2015.

*Primary Examiner* — Phillip A Johnston
(74) *Attorney, Agent, or Firm* — John R. Kasha; Kelly L. Kasha; Kasha Law LLC

(57) ABSTRACT

Systems and methods are provided for selecting and fragmenting a first precursor ion in an MS3 experiment. One or more first excitation parameters are calculated that define a first dipole excitation using a processor. The first dipole excitation is used to select a first precursor ion and fragment the first precursor ion to produce a second precursor ion. The first dipole excitation is applied to the continuous beam of ions by sending a first set of data including the first excitation parameters to a mass spectrometer. The first set of data is sent so that a first quadrupole applies the first dipole excitation to a continuous beam of ions. The mass spectrometer includes an ion source that provides the continuous beam of ions and the first quadrupole that receives the continuous beam of ions and is adapted to apply dipole excitation to the continuous beam of ions.

20 Claims, 17 Drawing Sheets

(51) Int. Cl.
*H01J 49/06* (2006.01)
*H01J 49/40* (2006.01)
*H01J 49/42* (2006.01)

(52) U.S. Cl.
CPC ..... *H01J 49/063* (2013.01); *H01J 49/40* (2013.01); *H01J 49/4225* (2013.01); *H01J 49/4215* (2013.01); *H01J 49/4285* (2013.01)

(56) References Cited

U.S. PATENT DOCUMENTS 7,145,133 B2 * 12/2006 Thomson ..... H01J 49/0081 250/281
8,378,298 B2 * 2/2013 Collings ..... H01J 49/427 250/282
8,742,333 B2 * 6/2014 Coon ..... H01J 49/004 250/282
2008/0017789 A1 * 1/2008 Hager ..... H01J 49/004 250/283
2009/0194684 A1 8/2009 Guna et al.
2010/0237236 A1 * 9/2010 Thomson ..... H01J 49/0045 250/283
2011/0006200 A1 1/2011 Loboda
2013/0032709 A1 2/2013 Chen et al.
2013/0056627 A1 3/2013 Verenchikov
2013/0228679 A1 9/2013 Makarov et al.
2016/0247671 A1 * 8/2016 Collings ..... H01J 49/428

FOREIGN PATENT DOCUMENTS

WO 2008037058 A1 4/2008
WO 2013092923 A2 6/2013

* cited by examiner

100

800

900

1100

1200

1300

1400

FLOW THROUGH $MS^3$ FOR IMPROVED SELECTIVITY

CROSS REFERENCE TO RELATED APPLICATION

This application claims the benefit of U.S. Provisional Patent Application Ser. No. 61/901,096, filed Nov. 7, 2013, the content of which is incorporated by reference herein in its entirety.

INTRODUCTION

Mass spectrometry/mass spectrometry/mass spectrometry ($MS^3$) is an increasing popular technique for quantitation experiments. Like mass spectrometry/mass spectrometry (MS/MS), which is commonly used in quantitation, $MS^2$ involves selecting a precursor ion for fragmentation and monitoring the fragmentation for a first generation fragment ion, or product ion. However, $MS^3$ includes the additional step of fragmenting the product ion and monitoring that fragmentation for one or more second generation fragment ions. This additional step gives $MS^3$ experiments greater specificity and greater resilience to chemical noise in comparison to MS/MS experiments.

Unfortunately, current standard $MS^3$ experiments require added time for ion trapping, cooling, and activation. Such is the case with the present linear ion trap (e.g., quadrupole ion trap (QTrap)) technology and would be necessary for any trap time-of-flight (TrapToF) technology in the future.

Current solutions to speed up $MS^3$ experiments use, to some degree, a declustering potential (between the orifice plate and skimmer) to cause an ion to fragment in the source region. However, this technique does not allow background to be removed from the fragment ion selected by the Q1 mass analyzing quadrupole.

Using the declustering potential to cause ion fragmentation gives the user access to a crude form of $MS^3$ on a triple quadrupole mass spectrometer that is really designed for MS/MS multiple reaction monitoring (MRM) measurements. This means $MS^3$ can be accessed without the use of an ion trap instrument. It does not speed up the $MS^3$ technique. The orifice is an atmospheric pressure sampling orifice.

This declustering method is also not as effective on instruments employing the QJet technology instead of the orifice-skimmer technology. The orifice/skimmer combination is more effective when set up to cause ion fragmentation than an orifice/high pressure quadrupole combination, such as the QJet technology (I.e. QJet) or orifice/high pressure ion funnel combination. High sensitivity instruments are tending towards the use of orifice/high pressure quadrupole or orifice/high pressure ion funnel combinations with the use of larger orifices. These configurations have a reduced ability to produce fragment ions in the interface region when compared to the orifice/skimmer combination.

SUMMARY

A system is disclosed for selecting and fragmenting a first precursor ion in a mass spectrometry/mass spectrometry/mass spectrometry ($MS^3$) experiment. The system includes a mass spectrometer and a processor. The mass spectrometer includes an ion source that provides a continuous beam of ions. The mass spectrometer further includes a first quadrupole that receives the continuous beam of ions and is adapted to apply dipole excitation to the continuous beam of ions.

The processor calculates one or more first excitation parameters. The one or more first excitation parameters define a first dipole excitation. The first dipole selects a first precursor ion and fragments the first precursor ion to produce a second precursor ion. The processor applies the first dipole excitation to the continuous beam of ions. The first dipole excitation is applied by sending a first set of data to the mass spectrometer so that the first quadrupole applies the first dipole excitation to the continuous beam of ions. The first set of data includes the first excitation parameters.

A method is disclosed for selecting and fragmenting a first precursor ion in an $MS^3$ experiment. One or more first excitation parameters are calculated using a processor. The one or more first excitation parameters define a first dipole excitation. The first dipole excitation selects a first precursor ion and fragments the first precursor ion to produce a second precursor ion.

The first dipole excitation is applied to the continuous beam of ions using the processor. The first dipole excitation is applied by sending a first set of data to a mass spectrometer so that a first quadrupole applies the first dipole excitation to a continuous beam of ions. The first set of data includes the first excitation parameters. The mass spectrometer includes an ion source that provides the continuous beam of ions. The mass spectrometer further includes the first quadrupole. The first quadrupole receives the continuous beam of ions and is adapted to apply dipole excitation to the continuous beam of ions.

A computer program product is disclosed that includes a non-transitory and tangible computer-readable storage medium whose contents include a program with instructions being executed on a processor so as to perform a method for selecting and fragmenting a first precursor ion in an $MS^3$ experiment.

The method includes providing a system, wherein the system comprises one or more distinct software modules, and wherein the distinct software modules comprise an analysis module and a control module. The analysis module calculates one or more first excitation parameters. The one or more first excitation parameters define a first dipole excitation. The first dipole excitation selects a first precursor ion and fragments the first precursor ion to produce a second precursor ion.

The control module applies the first dipole excitation to the continuous beam of ions. The first dipole excitation is applied by sending a first set of data to a mass spectrometer so that a first quadrupole applies the first dipole excitation to a continuous beam of ions. The first set of data includes the first excitation parameters. The mass spectrometer includes an ion source that provides the continuous beam of ions. The mass spectrometer further includes the first quadrupole. The first quadrupole receives the continuous beam of ions and is adapted to apply dipole excitation to the continuous beam of ions.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
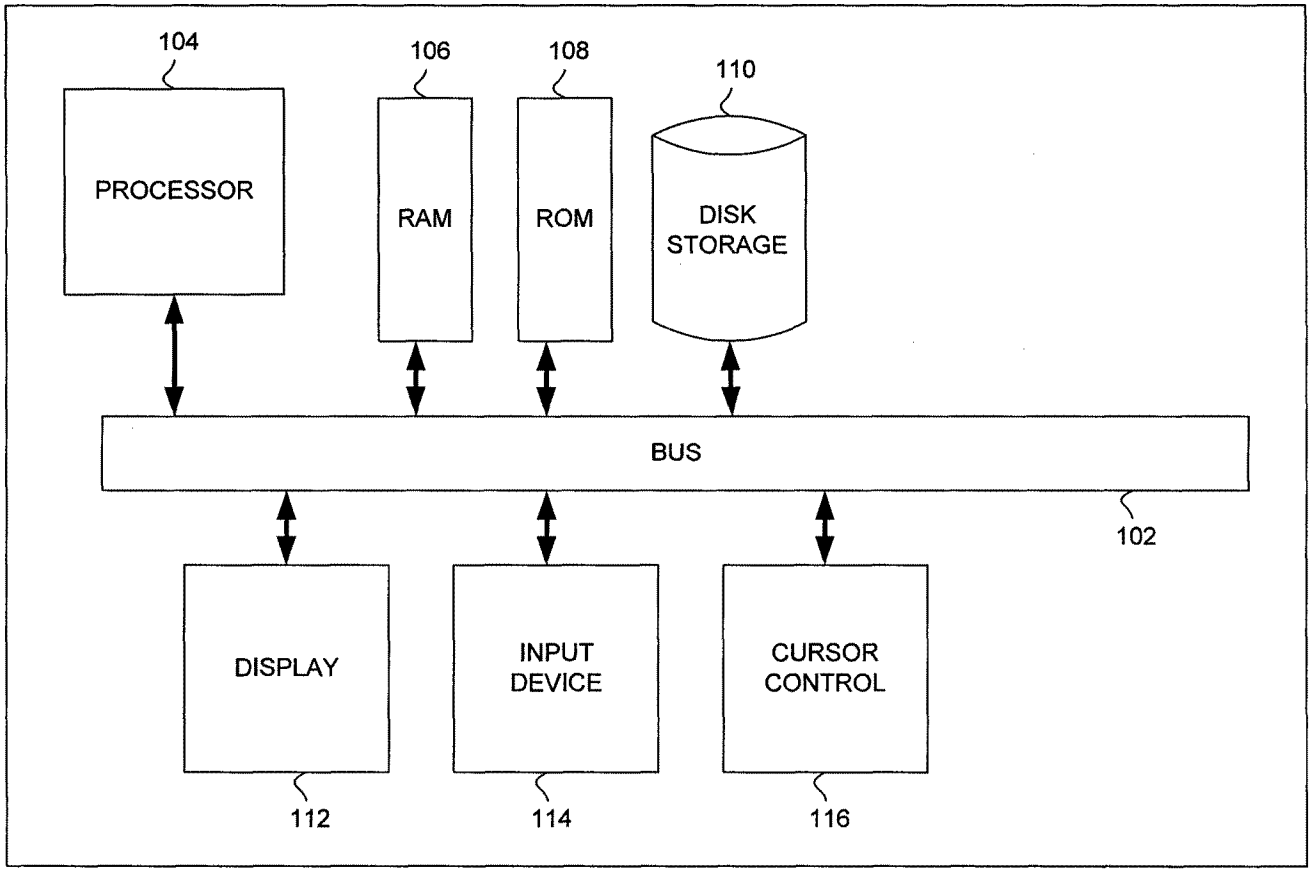
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Flow Through $MS^3$

As described above, current standard mass spectrometry/mass spectrometry/mass spectrometry ($MS^3$) experiments require added time for ion trapping, cooling, and activation. Such is the case with the present linear ion trap (e.g., quadrupole ion trap (QTrap)) technology and would be necessary for any ion trap technology in the future.

In various embodiments, methods and systems for flow through $MS^3$ provide added functionality to various tandem mass spectrometry instruments, such as triple quadrupole and quadrupole-time-of-flight (Q-TOF) instruments.

In various embodiments, methods and systems for flow through $MS^3$ can be implemented on a tandem mass spectrometer, such as a Q-TOF mass spectrometer, a triple quadrupole mass spectrometer, or a linear ion trap (e.g., QTrap) mass spectrometer. One skilled in the art will appreciate that other types of mass spectrometers can equally be applied.

In various embodiments, methods and systems for flow through $MS^3$ provide a rapid $MS^3$ alternative for tandem mass spectrometry instruments. In particular, embodiments provide much faster cycle times as compared to the standard $MS^3$ experiments that require added time for ion trapping, cooling, and activation. As a result, embodiments provide very fast $MS^3$ experiments available to both current and future linear ion trap (such as QTrap) and Q-TOF customers.

In various embodiments, methods and systems for flow through $MS^3$ provide $MS^3$ functionality to non-trap instruments. In various embodiments, methods and systems for flow through $MS^3$ provide $MS^4$ and multiple reaction monitoring $(MRM)^4$ functionality to linear ion trap (e.g., QTrap) instruments. For example, $MS^3$ can be promoted to $MS^4$, and $MRM^3$ can be promoted to $MRM^4$ without any effect on duty cycle.

In various embodiments, flow through $MS^3$ is performed by exciting a precursor ion in Q0 of a mass spectrometer according to the following steps.

1. Dipole excitation is used to fragment a precursor ion (referred to as the first precursor) in the Q0 quadrupole.
2. A fragment of the first precursor (referred to as the second precursor) is mass selected in the Q1 mass analyzing quadrupole.
3. The second precursor is accelerated into the Q2 collision cell for high energy collision induced dissociation (CID).
4. The fragment ions are collected to create a mass spectrum using either a time-of-flight (TOF) mass analyzer, a quadrupole Q3 mass analyzer or a linear ion trap (e.g., QTrap) mass analyzer. One skilled in the art will appreciate that other types of mass analyzers can equally be used.

Figure 2:
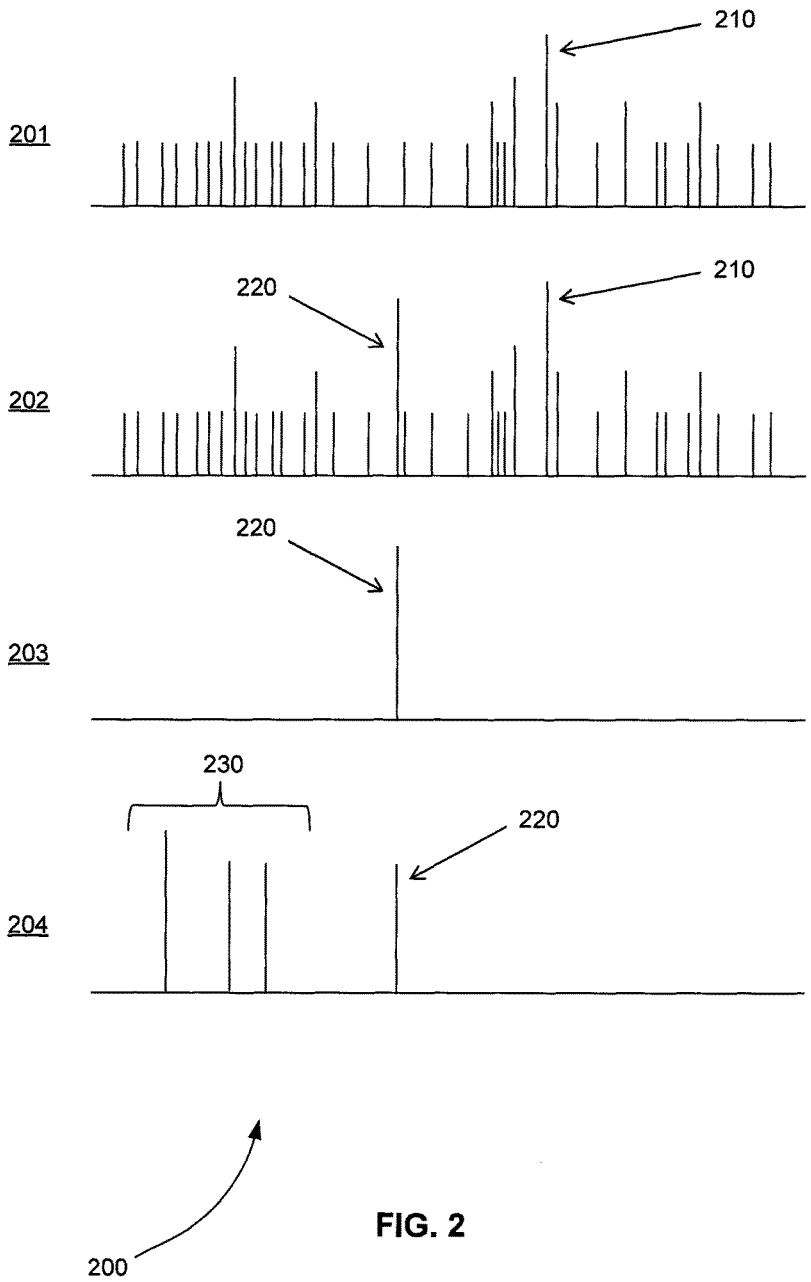
FIG. 2 depicts a series of hypothetical mass spectra that show how ions are selected and fragmented in a method of flow through mass spectrometry/mass spectrometry/mass spectrometry ($MS^3$) that is performed by exciting a precursor ion in Q0 of a mass spectrometer, in accordance with various embodiments.

FIG. 2 depicts a series of hypothetical mass spectra 200 that show how ions are selected and fragmented in a method of flow through $MS^3$ that is performed by exciting a precursor ion in Q0 of a mass spectrometer, in accordance with various embodiments. Note that one skilled in the art can appreciate that hypothetical mass spectra 200 are provided in order to help explain the method and are not required for the method. Hypothetical mass spectrum 201 shows ions entering the Q0 quadrupole without any excitation applied to the Q0 quadrupole. Hypothetical mass spectrum 201 also shows first precursor 210. Hypothetical mass spectrum 202 shows the appearance of a second precursor ion 220 that results from the excitation of first precursor 210 in the Q0 quadrupole. Hypothetical mass spectrum 203 shows the result if the Q1 mass analyzing quadrupole is set to transmit only second precursor ion 220. Hypothetical mass spectrum 204 shows the result after second precursor ion 220 is accelerated into the Q2 collision cell and collision induced dissociation (CID) is performed. Hypothetical mass spectrum 204, therefore, also shows fragments 230 ions of second precursor ion 220.

Figure 3:
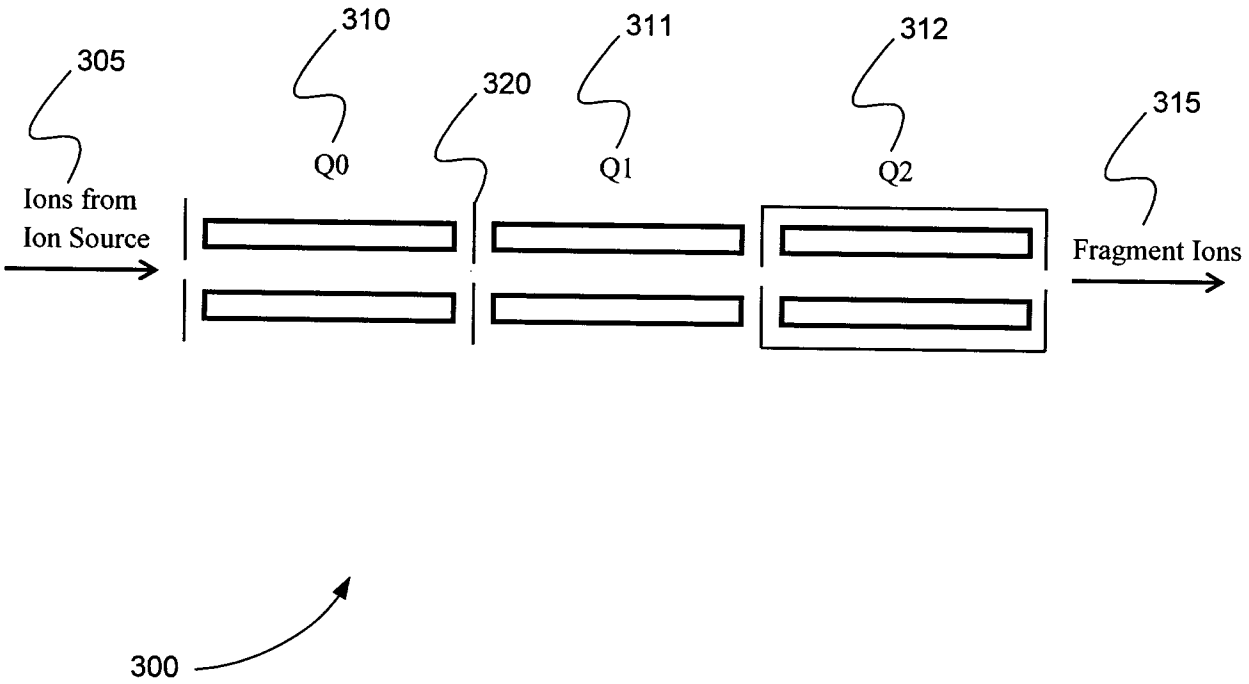
FIG. 3 is a schematic diagram of a series of quadrupoles that perform flow through $MS^3$ by exciting a precursor ion in the Q0 quadrupole, in accordance with various embodiments.

FIG. 3 is a schematic diagram of a series of quadrupoles 300 that perform flow through $MS^3$ by exciting a precursor ion in the Q0 quadrupole 310, in accordance with various embodiments. Series of quadrupoles 300 include quadrupole 310, quadrupole 311, and quadrupole 312. A beam of precursor ions 305 is transmitted to quadrupole 310 from an ion source (not shown). Quadrupole 310 is a Q0 quadrupole, quadrupole 311 is a Q1 quadrupole, and quadrupole 312 is a Q2 quadrupole, for example. IQ1 lens is located between quadrupole 310 and quadrupole 311.

Quadrupole 310 is an ion guide and quadrupole 311 is a mass filter, for example. Quadrupole 310 and quadrupole 311 can both be ion guides. However, a typical ion guide does not have the ability to apply resolving direct current (DC) to the quadrupole, whereas a mass filter does.

Precursor ion selection takes place in both quadrupole 310 and quadrupole 311. Fragmentation takes place in quadrupole 310 and quadrupole 312, for example. Quadrupole 312 is a fragmentation device or collision cell, for example. One skilled in the art can appreciate that any type of fragmentation device can be used. Product ions 315 of the selected precursor ions are transmitted from quadrupole 312 for mass analysis, for example.

In various embodiments, excitation of the first precursor ion takes place in the Q0 quadrupole 310 using dipole excitation, for example. One skilled in the art can appreciate that other types of excitation methods, can equally be used.

In various embodiments, the choice of frequency is dependent upon the Mathieu q value for the ion of interest. The q value is defined by equation (1)

$$q = \frac{4eV_{rf}}{mr_0^2\Omega^2} \tag{1}$$

where e is the electronic charge, $V_{rf}$ is the radio frequency (RF) amplitude measured pole to ground, m is the mass of the ion and $r_0$ is the field radius of the quadrupole, and $\Omega$ is the angular drive frequency of the quadrupole. As can be seen from equation (1), each ion has its own particular q value when the RF amplitude is held constant. An ion's secular frequency of motion, $\omega_0$, can be determined using equation (2)

$$\omega_0 = \beta\frac{\Omega}{2} \tag{2}$$

where $\beta$ is a function of q. The excitation is applied at the secular frequency of the ion of interest.

In various embodiments, the excitation can be applied either between a pair of Q0 quadrupole rods or between a pair of auxiliary electrodes.

Figure 4:
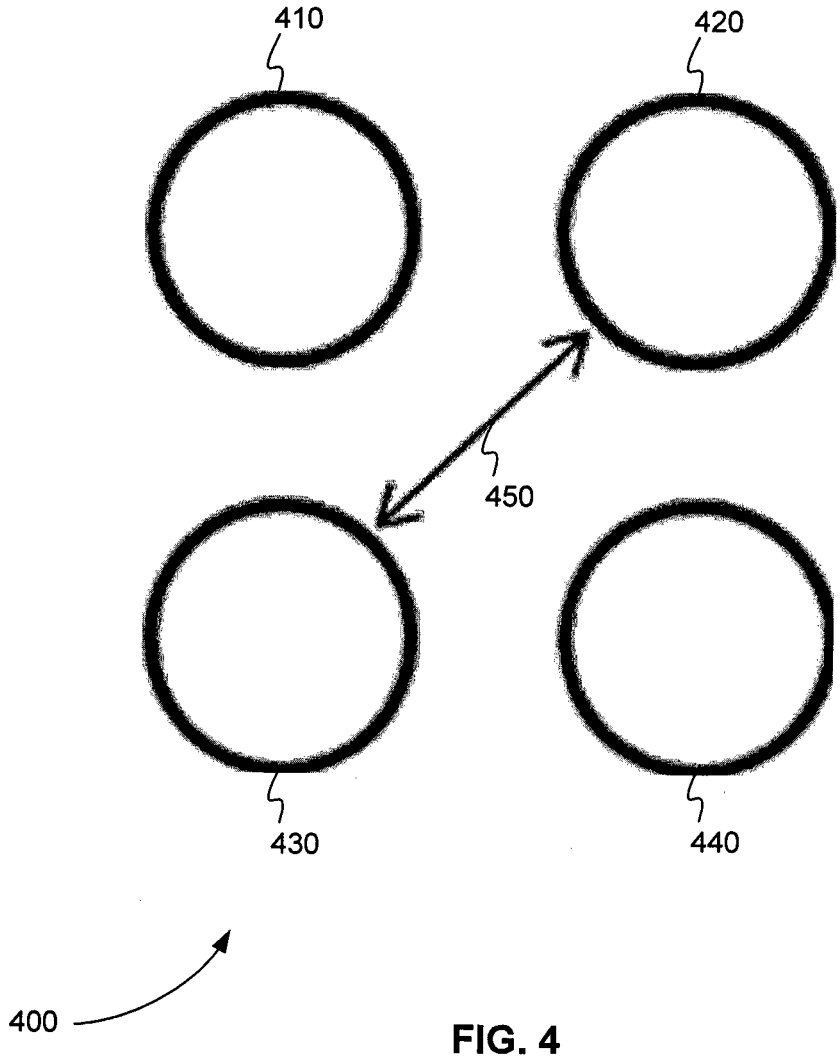
FIG. 4 is a cross sectional diagram of quadrupole rods showing how dipole excitation is applied between a pair of quadrupole rods, in accordance with various embodiments.

FIG. 4 is a cross sectional diagram of quadrupole rods 400 showing how dipole excitation is applied between a pair of quadrupole rods, in accordance with various embodiments. Dipole excitation 450 is applied between quadrupole rod 420 and quadrupole rod 430, for example. Dipole excitation can also be applied between quadrupole rod 410 and quadrupole rod 440, for example. By applying dipole excitation to the rods of a quadrupole, the modification to the quadrupole is minimal with no need for additional electrodes to be added to the quadrupole.

Figure 5:
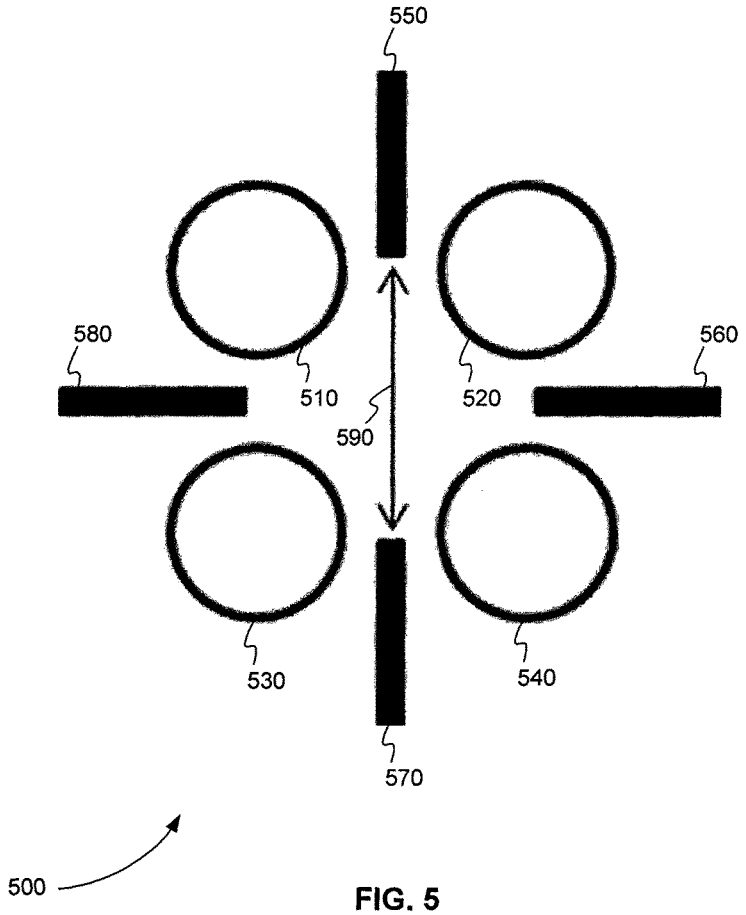
FIG. 5 is a cross sectional diagram of quadrupole rods showing how dipole excitation is applied between a pair of auxiliary electrodes placed between quadrupole rods, in accordance with various embodiments.

FIG. 5 is a cross sectional diagram of quadrupole rods 500 showing how dipole excitation is applied between a pair of auxiliary electrodes placed between quadrupole rods, in accordance with various embodiments. Auxiliary electrodes 550-580 are placed between the quadrupole rods 510-540. Dipole excitation 590 is applied between auxiliary electrode 550 and auxiliary electrode 570. Dipole excitation can also be applied between auxiliary electrode 560 and auxiliary electrode 580.

Returning to FIG. 3, in various embodiments, the pressure in the Q0 quadrupole 310 is typically between 3 to 10 mTorr of nitrogen. At this pressure, ions require several milliseconds to pass through the quadrupole 310. This amount of time is sufficient for the excitation waveform to effectively fragment or remove the ion of interest. Fragmentation results from internal excitation of the ion through collisions with the background gas, such as nitrogen. Ions are removed by driving them to the rods or the electrodes where they become neutralized. One skilled in the art will appreciate that other types of background gas can equally be used.

Preliminary Experimental Results and Background Interference

In accordance of various embodiments, some preliminary experimental results were obtained for flow through $MS^3$ by exciting a first precursor ion in the Q0 quadrupole using reserpine (m/z 609.2) as the first precursor ion.

Figure 6:
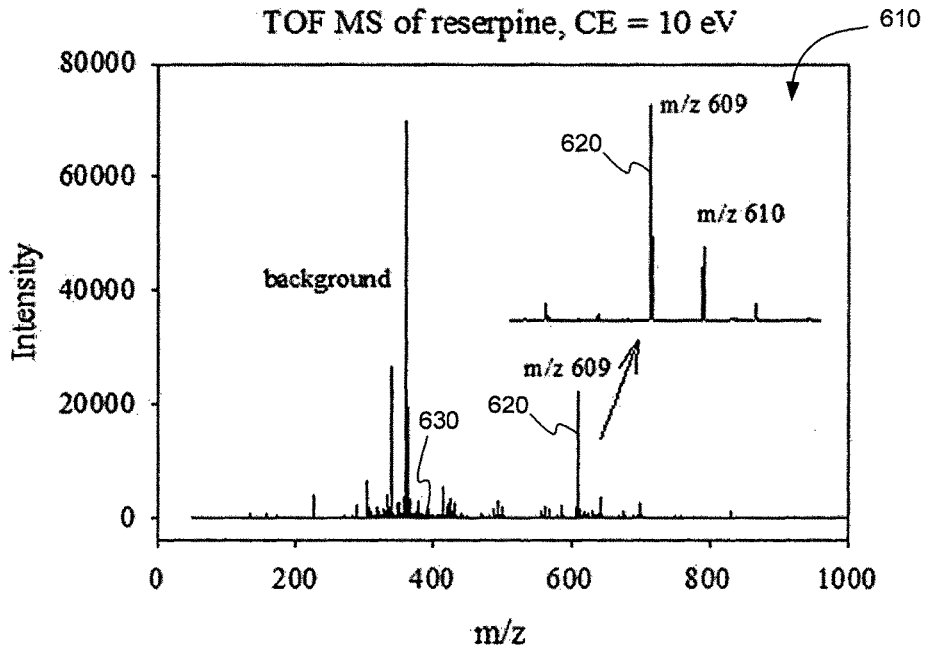
FIG. 6 is an exemplary time-of-flight (TOF) mass spectrum when the Q1 resolving direct current (DC) potential is set to 0 V, in accordance of various embodiments.
Figure 6:
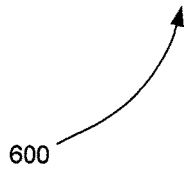

FIG. 6 is an exemplary TOF mass spectrum 600 when the Q1 resolving DC potential is set to 0 V, in accordance of various embodiments. TOF mass spectrum 600 includes magnified section 610. Setting the Q1 resolving DC potential to 0 V allows all ions in Q0 to be transmitted through Q1 and into the TOF section of the spectrometer. Both mass spectrum 600 and magnified section 610 show peaks 620 for first precursor ion reserpine. Mass spectrum 600 also shows background ion 630 at m/z 397.

Figure 7:
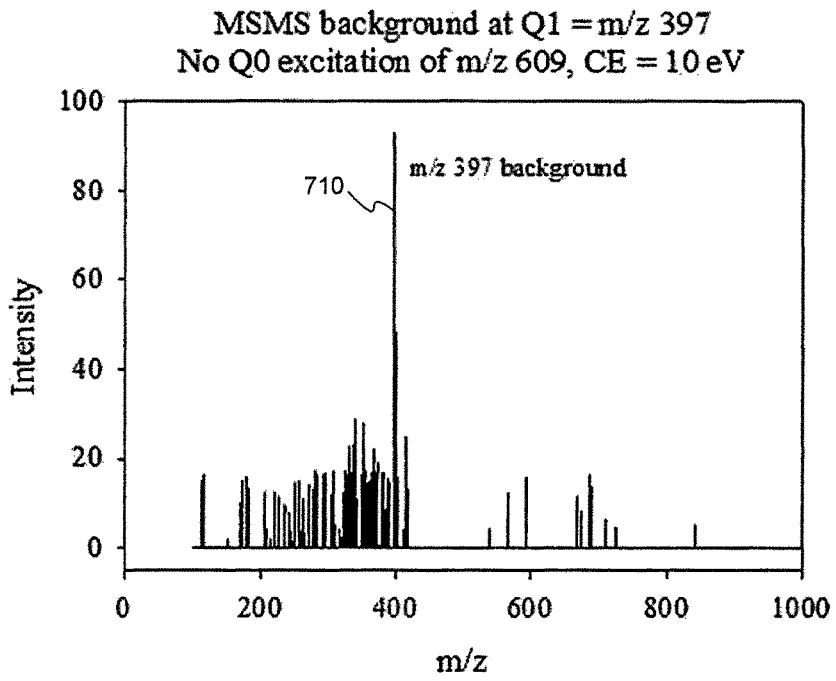
FIG. 7 is an exemplary TOF mass spectrum when Q1 is set to transmit the second precursor ion at m/z 397, which is a known fragment of a first precursor ion at m/z 609.2, in accordance of various embodiments.
Figure 7:
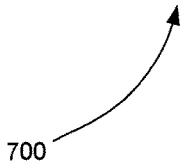

FIG. 7 is an exemplary TOF mass spectrum 700 when Q1 is set to transmit the second precursor ion at m/z 397, which is a known fragment of a first precursor ion at m/z 609.2, in accordance of various embodiments. Transmitted ion 710 at m/z 397, however, is the background ion 630 from FIG. 6. Therefore, FIG. 7 shows how the background can be transmitted along with a second precursor ion producing background interference.

Figure 8:
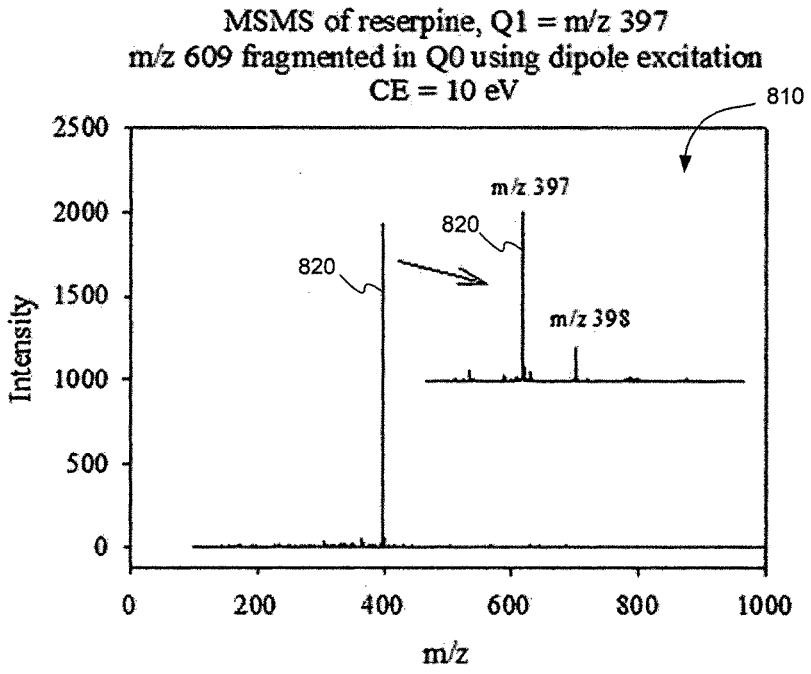
FIG. 8 is an exemplary TOF mass spectrum when a first precursor ion at m/z 609.2 is fragmented in quadrupole Q0 using dipole excitation and a collision energy of 10 eV is used in quadrupole Q2, in accordance of various embodiments.

FIG. 8 is an exemplary TOF mass spectrum 800 when a first precursor ion at m/z 609.2 is fragmented in quadrupole Q0 using dipole excitation and a collision energy of 10 eV is used in quadrupole Q2, in accordance of various embodiments. TOF mass spectrum 800 includes magnified section 810. Both mass spectrum 800 and magnified section 810 show peaks 820 for second precursor ion at m/z 397.

Figure 9:
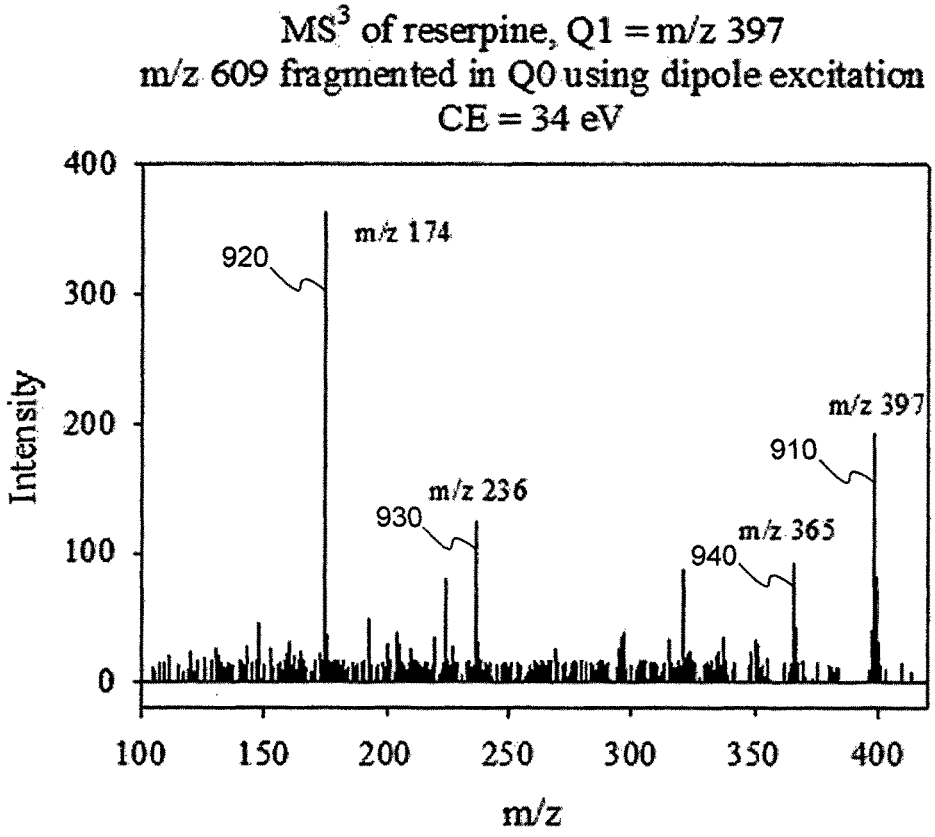
FIG. 9 is an exemplary TOF mass spectrum when a first precursor ion at m/z 609.2 is fragmented in quadrupole Q0 using dipole excitation and a collision energy of 34 eV is used in quadrupole Q2, in accordance of various embodiments.

FIG. 9 is an exemplary TOF mass spectrum 900 when a first precursor ion at m/z 609.2 is fragmented in quadrupole Q0 using dipole excitation and a collision energy of 34 eV is used in quadrupole Q2, in accordance of various embodiments. A comparison of FIG. 9 with FIG. 8 shows that a higher collision energy applied to Q2 not only produces second precursor ion 910 at m/z 397, but produces fragments 920-940 of second precursor ion 910 as well. Due to background interference, however, peaks 820 in FIG. 8 and second precursor ion 910 may include contributions from background ions.

Removing Background Interference

In various embodiments, in order to remove background interference in a method for flow through $MS^3$ where a precursor ion is excited and fragmented in the Q0 quadrupole, ions at the second precursor ion mass are removed before performing the excitation and fragmentation in the Q0 quadrupole.

In a preferred embodiment, the second precursor ion region is cleared of background ions while operating in flow through mode. Excitation is performed in Q0 using two sets of auxiliary electrodes located in series along the axis of the Q0 quadrupole.

Figure 10:
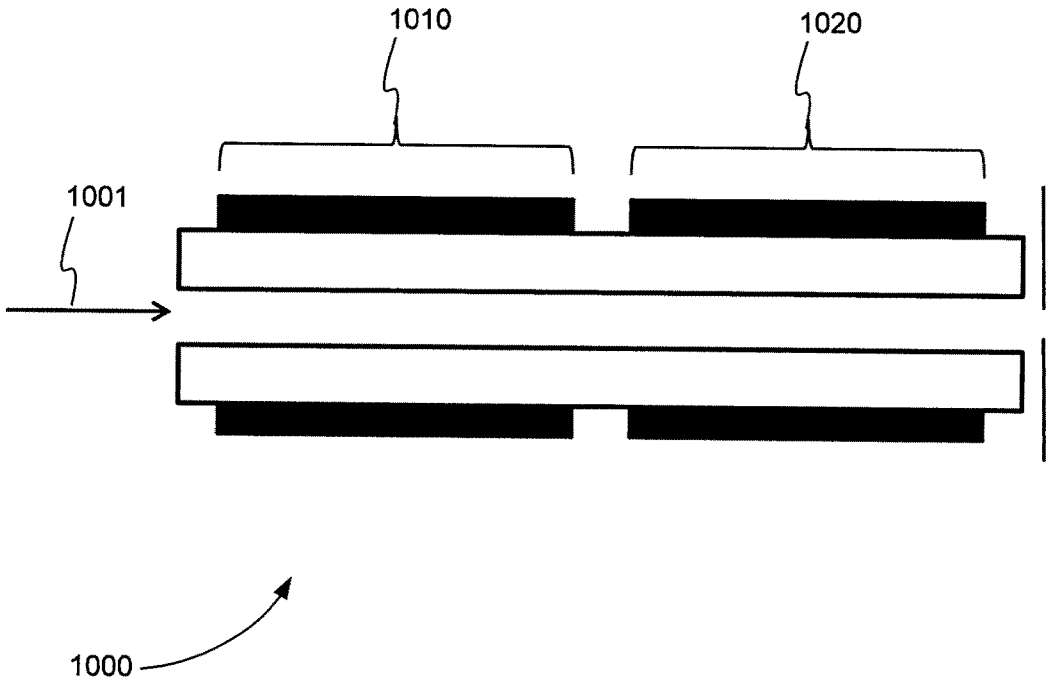
FIG. 10 is schematic diagram of an exemplary Q0 quadrupole for flow through $MS^3$ where the second precursor ion region is cleared of background ions before a first precursor ion is selected and fragmented, in accordance with various embodiments.

FIG. 10 is schematic diagram of an exemplary Q0 quadrupole 1000 for flow through $MS^3$ where the second precursor ion region is cleared of background ions before a first precursor ion is selected and fragmented, in accordance with various embodiments. Excitation is performed in quadrupole 1000 using two sets of T bars 1010 and 1020 located in series along the axis of quadrupole 1000. Ions 1001 enter quadrupole 1000 and pass through first set of auxiliary electrodes 1010 where dipole excitation is applied to clear out the second precursor mass region. The ions then pass into the region containing second set of auxiliary electrodes 1020 that applies dipole excitation to the first precursor to create the second precursor.

The second precursor is then selected in the Q1 mass analyzing quadrupole (not shown) for fragmentation in the Q2 collision cell (not shown). This technique maintains the flow through characteristic and provides a cleaner $MS^3$ spectrum without as much background interference.

In another embodiment, the second precursor ion region is cleared of background ions using a trapping method in the Q0 quadrupole. Returning to FIG. 3, ions are trapped in Q0 quadrupole 310 by raising the potential on the IQ1 lens 320 and on a set of auxiliary electrodes (not shown) located at the entrance end of quadrupole 310. Ions at the second precursor mass are removed using dipole excitation in quadrupole 310. The first precursor is then fragmented in quadrupole 310 using dipole excitation. The IQ1 lens 320 potential is then lowered to allow ions to be transmitted to Q1 mass analyzing quadrupole 311 that is set to transmit ions at the second precursor mass. The collision energy is then adjusted to cause CID of the second precursor in Q2 collision cell 312 and the $MS^3$ spectrum is collected using a mass analyzer (not shown). One skilled in the art can appreciate that in this trapping method, a continuous beam of ions is received from an ion source, however, only a portion of the continuous beam of ions may be used at any one time.

Preliminary Experimental Results after Background Removal

FIGS. 11 to 14 describe a technique when using Q0 as a trapping region. Therefore, the results shown in FIGS. 11 to 14 do not correspond to the flow through $MS^3$ technique using auxiliary electrodes as shown in FIG. 10.

Figure 11:
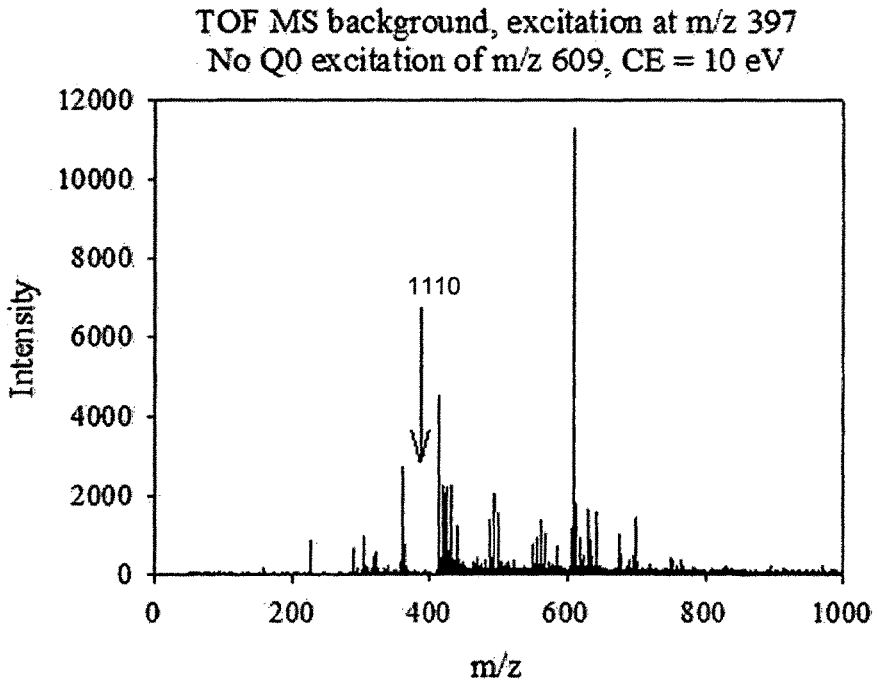
FIG. 11 is an exemplary TOF mass spectrum resulting from the same experiment as shown in FIG. 6 except that an excitation frequency is applied at m/z 397 in quadrupole Q0, in accordance with various embodiments.

FIG. 11 is an exemplary TOF mass spectrum 1100 resulting from the same experiment as shown in FIG. 6 except that an excitation frequency is applied at m/z 397 in quadrupole Q0, in accordance with various embodiments. In this particular example, the excitation in quadrupole Q0 was applied for 5 ms using an excitation amplitude of 4.3 V and a frequency of 220 kHz across the Q0 rods. This level of excitation has cleared out region 1110 around m/z 397 for several Daltons.

Figure 12:
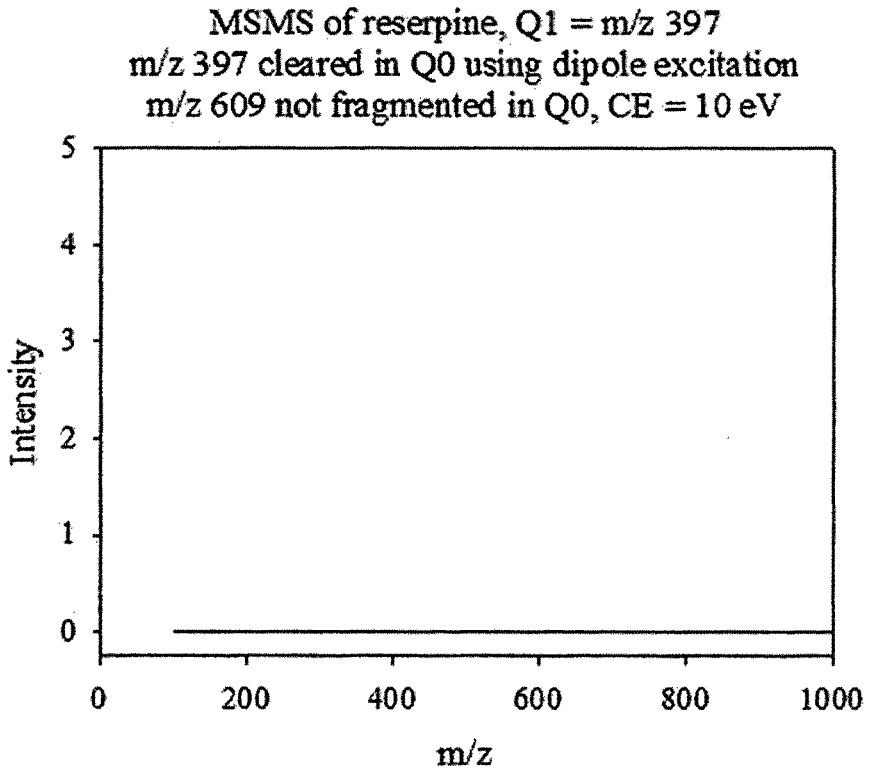
FIG. 12 is an exemplary TOF mass spectrum when the ions of the spectrum in FIG. 11 are mass selected in quadrupole Q1 at m/z 397, in accordance with various embodiments.

FIG. 12 is an exemplary TOF mass spectrum 1200 when the ions of the spectrum in FIG. 11 are mass selected in quadrupole Q1 at m/z 397, in accordance with various embodiments. Comparing spectrum 1200 with the spectrum of FIG. 7 shows that the background ions have been removed.

After the m/z 397 (second precursor) region has been cleared, the m/z 609.2 (first precursor) is fragmented. The m/z 609.2 (first precursor) is fragmented for a period of 20 ms at a frequency of 137 kHz and an amplitude of 1.5 V, for example.

Figure 13:
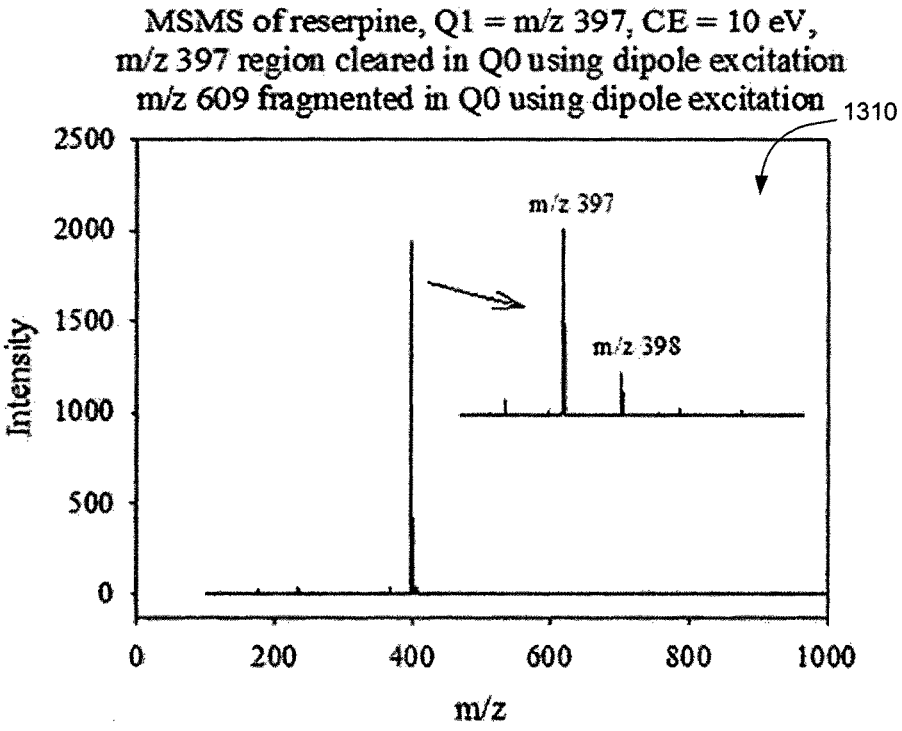
FIG. 13 is an exemplary TOF mass spectrum after the m/z 397 (second precursor) region has been cleared, the m/z 609.2 (first precursor) has been fragmented, ions have been mass selected in Q1, and a collision energy of 10 eV has been applied in quadrupole Q2, in accordance with various embodiments.

FIG. 13 is an exemplary TOF mass spectrum 1300 after the m/z 397 (second precursor) region has been cleared, the m/z 609.2 (first precursor) has been fragmented, ions have been mass selected in Q1, and a collision energy of 10 eV has been applied in quadrupole Q2, in accordance with various embodiments. TOF mass spectrum 1300 includes magnified section 1310. Comparing spectrum 1300 with the spectrum of FIG. 8 shows a reduction in background ions.

Figure 14:
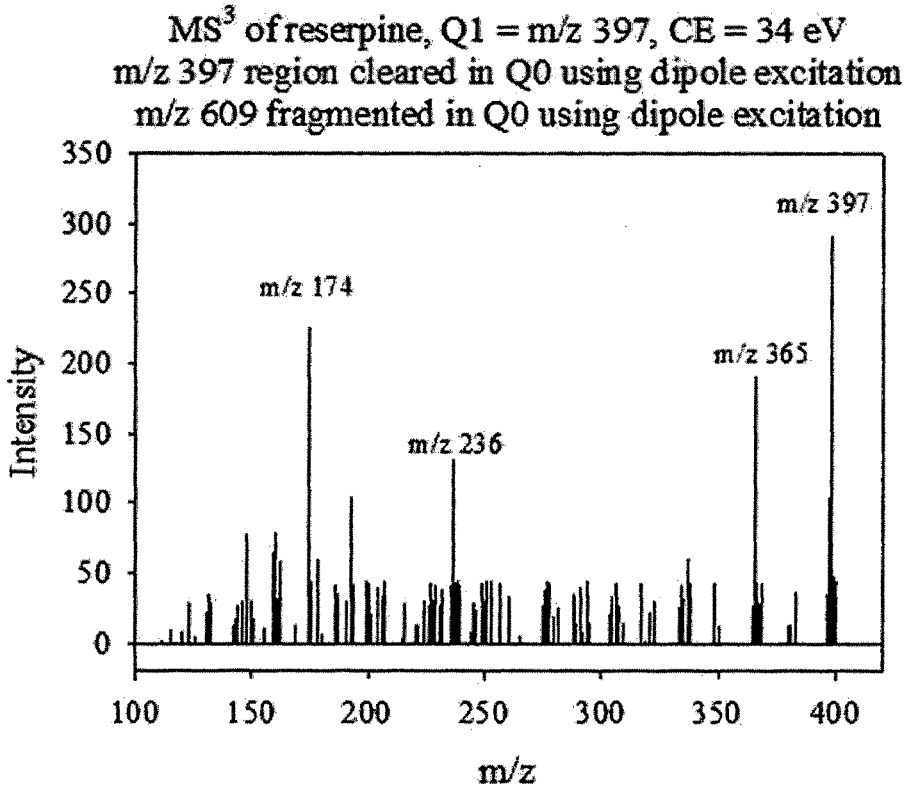
FIG. 14 is an exemplary TOF mass spectrum after the m/z 397 (second precursor) region has been cleared, the m/z 609.2 (first precursor) has been fragmented, ions have been mass selected in Q1, and a collision energy of 34 eV has been applied in quadrupole Q2, in accordance with various embodiments.

FIG. 14 is an exemplary TOF mass spectrum 1400 after the m/z 397 (second precursor) region has been cleared, the m/z 609.2 (first precursor) has been fragmented, ions have been mass selected in Q1, and a collision energy of 34 eV has been applied in quadrupole Q2, in accordance with various embodiments. Comparing spectrum 1400 with the spectrum of FIG. 9 also shows a reduction in background ions.

Dipole Excitation System

Figure 15:
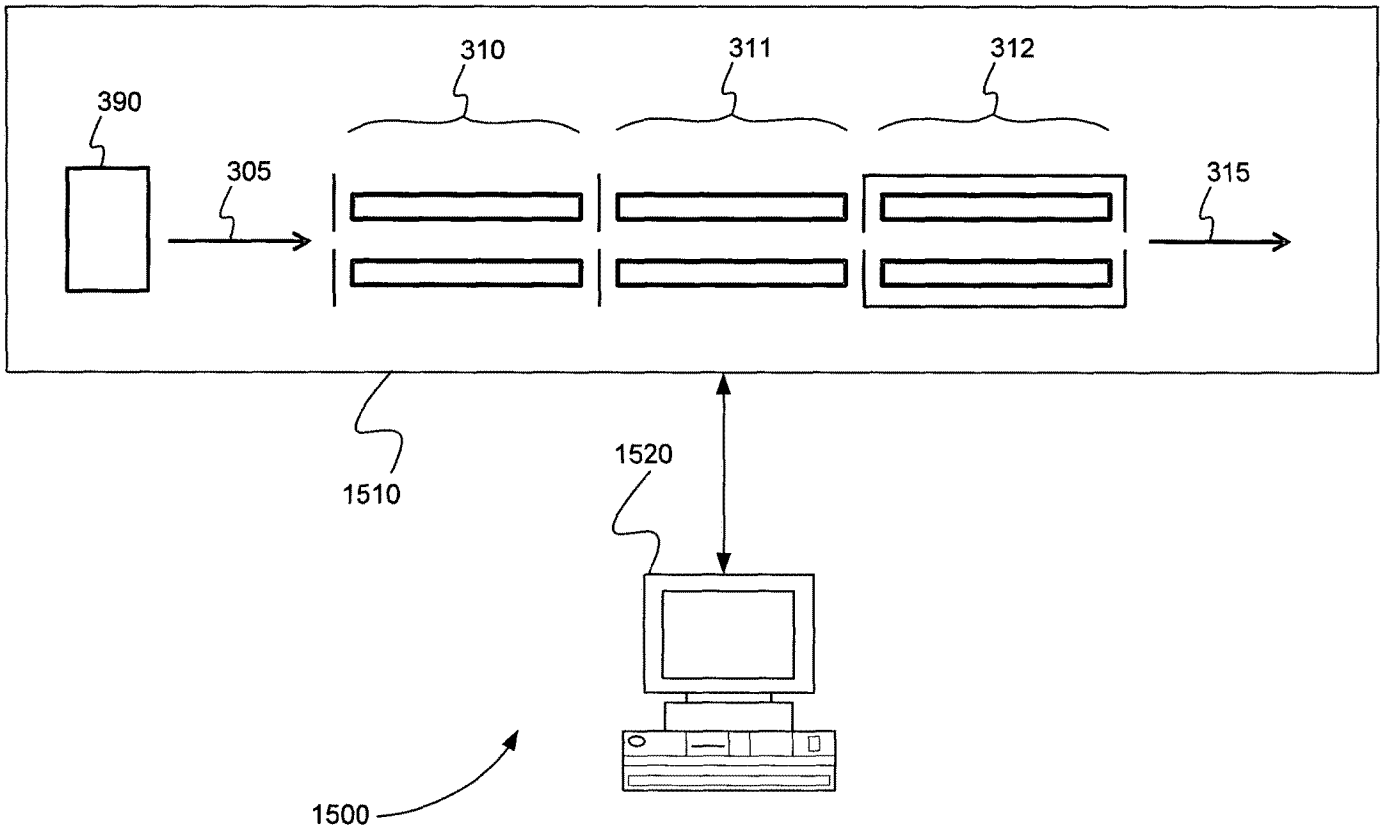
FIG. 15 is a schematic diagram of a system for selecting and fragmenting a first precursor ion in an $MS^3$ experiment, in accordance with various embodiments.

FIG. 15 is a schematic diagram of a system 1500 for selecting and fragmenting a first precursor ion in an $MS^3$ experiment, in accordance with various embodiments. System 1500 includes mass spectrometer 1510 and processor 1520.

Mass spectrometer 1510 includes ion source 390, first quadrupole 310, second quadrupole 311, and third quadrupole 312. Ion source 390 provides a continuous beam of ions to first quadrupole 310. First quadrupole 310 receives the continuous beam of ions from ion source 390. First quadrupole 310 is adapted to apply dipole excitation to the continuous beam of ions.

Processor 1520 can be, but is not limited to, a computer, microprocessor, or any device capable of sending and receiving control instructions and data to and from mass spectrometer 1510. Processor 1520 is in communication with mass spectrometer 1510.

Processor 1520 calculates one or more first excitation parameters that define a first dipole excitation. For example, the first excitation parameters can include one or more of a voltage, a frequency, and a duration. The first dipole excitation is used to select a first precursor ion and fragment the first precursor ion to produce a second precursor ion.

Processor 1520 applies the first dipole excitation to the continuous beam of ions. Processor 1520 does this by sending a first set of data including the first excitation parameters to the mass spectrometer 1510 so that first quadrupole 310 applies the first dipole excitation to the continuous beam of ions. The first set of data can also include control instructions, for example. Control instructions can include, for example, instructions on how mass spectrometer 1510 should apply the first excitation parameters to first quadrupole 310.

In various embodiments, first quadrupole 310 applies the first dipole excitation to the continuous beam of ions by applying the first dipole excitation between pairs of rods.

In various embodiments, first quadrupole 310 further includes auxiliary electrodes (not shown) placed between rods of first quadrupole 310. First quadrupole 310 then applies the first dipole excitation to the continuous beam of ions by applying the first dipole excitation between pairs of the auxiliary electrodes.

In various embodiments, processor 1520 further removes ions in a region of the second precursor ion before selecting and fragmenting the first precursor ion. Processor 1520 calculates one or more second excitation parameters that define a second dipole excitation that removes ions at a location of the second precursor ion. The application of the excitation at the location of the second precursor mass clears out that region by either causing the background ions to fragment or by ejecting them so that they neutralize on an electrode, for example. Processor 1520 then applies the second dipole excitation to the continuous beam of ions before the first dipole excitation. For example, processor 1520 additionally sends a second set of data that includes the second excitation parameters to the mass spectrometer 1510. The second set of data is sent so that first quadrupole 310 applies the second dipole excitation to the continuous beam of ions before the first quadrupole applies the first dipole excitation to the continuous beam of ions. The second set of data can also include control instructions, for example.

In various embodiments, the auxiliary electrodes placed between rods of first quadrupole 310 are further segmented into a first set of electrodes that receive the continuous beam of ions from the ion source and a second set of electrodes located in series along the axis of first quadrupole 310. Processor 1520 applies the second dipole excitation to the continuous beam of ions before the first dipole excitation using the first and second sets of electrodes. For example, processor 1520 sends the second set of data to mass spectrometer 1510 so that first quadrupole 310 applies the second dipole excitation to the first set of electrodes using the second excitation parameters and first quadrupole 310 applies the first dipole excitation to the second set of electrodes using the first excitation parameters.

In various embodiments, first quadrupole 310 further includes entrance electrodes (not shown) placed at an entrance end of the first quadrupole and an exit lens (not shown) at an exit end of first quadrupole 310. Processor 1520 applies the second dipole excitation to the continuous beam of ions before the first dipole excitation by sending the second set of data to mass spectrometer 1510. In response to the second set of data, mass spectrometer 1510 traps ions in first quadrupole 310 by applying a voltage potential on the entrance electrodes and the exit lens. Mass spectrometer 1510 applies the second dipole excitation to the trapped ions in first quadrupole 310 to remove ions in a region of the second precursor ion. Mass spectrometer 1510 applies the first dipole excitation to the trapped ions in first quadrupole 310 to select and fragment the first precursor ion. Mass spectrometer 1510 lowers the voltage potential on the exit lens to transmit the trapped ions to second quadrupole 311.

Dipole Excitation Method

Figure 16:
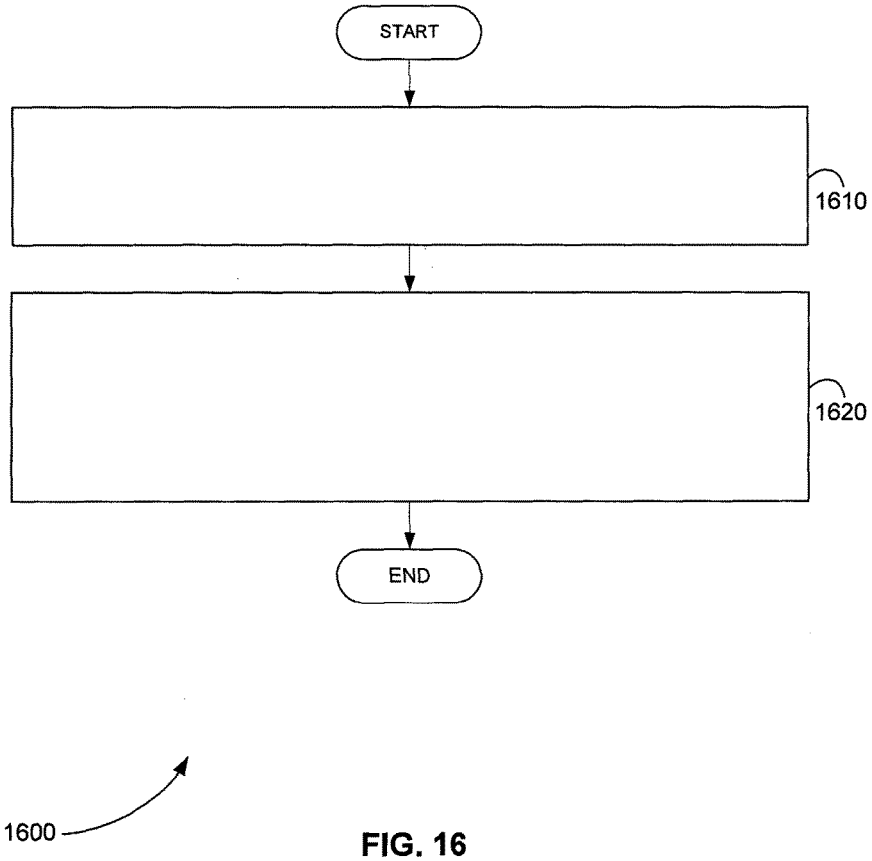
FIG. 16 is a flowchart showing a method for selecting and fragmenting a first precursor ion in an $MS^3$ experiment, in accordance with various embodiments.

FIG. 16 is a flowchart showing a method 1600 for selecting and fragmenting a first precursor ion in an $MS^3$ experiment, in accordance with various embodiments.

In step 1610 of method 1600, one or more first excitation parameters are calculated that define a first dipole excitation using a processor. The first dipole excitation is used to select a first precursor ion and fragment the first precursor ion to produce a second precursor ion.

In step 1620, the first dipole excitation is applied to the continuous beam of ions by sending a first set of data including the first excitation parameters to a mass spectrometer using the processor. The first set of data is sent so that a first quadrupole applies the first dipole excitation to a continuous beam of ions. The mass spectrometer includes an ion source that provides the continuous beam of ions and the first quadrupole that receives the continuous beam of ions and is adapted to apply dipole excitation to the continuous beam of ions.

Dipole Excitation Computer Program Product

Figure 17:
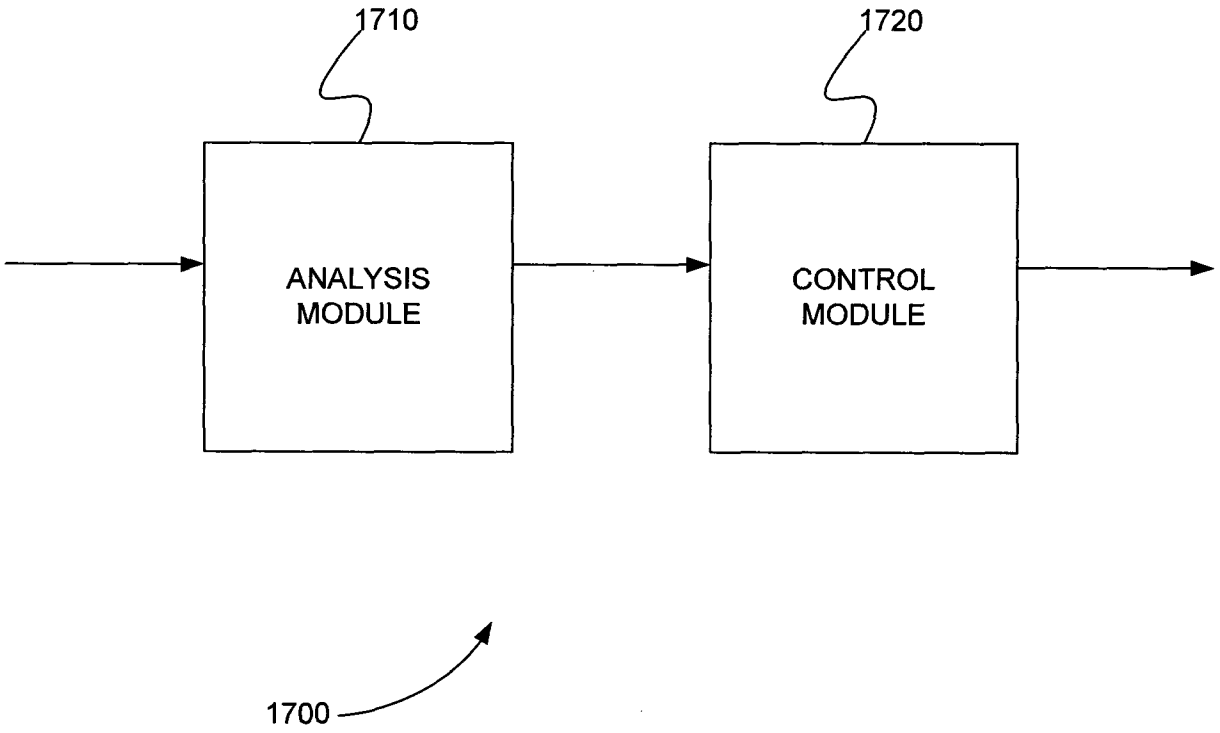
FIG. 17 is a schematic diagram of a system that includes one or more distinct software modules that performs a method for selecting and fragmenting a first precursor ion in an $MS^3$ experiment, in accordance with various embodiments.

In various embodiments, computer program products include a tangible computer-readable storage medium whose contents include a program with instructions being executed on a processor so as to perform a method for selecting and fragmenting a first precursor ion in an $MS^3$ experiment. This method is performed by a system that includes one or more distinct software modules FIG. 17 is a schematic diagram of a system 1700 that includes one or more distinct software modules that performs a method for selecting and fragmenting a first precursor ion in an $MS^3$ experiment, in accordance with various embodiments. System 1700 includes analysis module 1710 and control module 1720.

Analysis module 1710 calculates one or more first excitation parameters that define a first dipole excitation. The first dipole excitation is used to select a first precursor ion and fragment the first precursor ion to produce a second precursor ion.

Control module 1720 applies the first dipole excitation to the continuous beam of ions. Control module 1720 sends a first set of data that includes the first excitation parameters to a mass spectrometer. The first set of data is sent so that a first quadrupole applies the first dipole excitation to a continuous beam of ions. The mass spectrometer includes an ion source that provides the continuous beam of ions and the first quadrupole that receives the continuous beam of ions and is adapted to apply dipole excitation to the continuous beam of ions.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for selecting and fragmenting a first precursor ion in a mass spectrometry/mass spectrometry/mass spectrometry ($MS^3$) experiment, comprising:

a mass spectrometer that includes an ion source that provides a continuous beam of ions and a first quadrupole Q0 ion guide that receives the continuous beam of ions and is adapted to apply dipole excitation between rods or electrodes in the first quadrupole Q0 ion guide to excite the continuous beam of ions while passing through the first quadrupole Q0 ion guide; and a processor in communication with the mass spectrometer that calculates one or more first excitation parameters that define a first dipole excitation that selects a first precursor ion and fragments the first precursor ion to produce a second precursor ion, applies the first dipole excitation between rods or electrodes in the first quadrupole Q0 ion guide to excite the continuous beam of ions by sending a first set of data including the first excitation parameters to the mass spectrometer so that the first quadrupole Q0 ion guide applies the first dipole excitation between rods or electrodes in the first quadrupole Q0 ion guide select and fragment the first precursor ion in the first quadrupole Q0 ion guide and to produce the second precursor ion in the first quadrupole Q0 ion guide, wherein the second precursor ion is a fragment ion of the first precursor ion, mass selects the second precursor ion in a second quadrupole Q1, accelerates the second precursor ion to a third quadrupole Q2 for high energy collision induced dissociation (CID), and removes ions in a region of the second precursor ion in the first quadrupole Q0 ion guide before selecting and fragmenting the first precursor ion in the first quadrupole Q0 ion guide.

2. The system of claim 1, wherein the first excitation parameters comprise one or more of a voltage, a frequency, and a duration.

3. The system of claim 1, wherein the first quadrupole Q0 ion guide applies the first dipole excitation between rods or electrodes in the first quadrupole Q0 ion guide to excite the continuous beam of ions by applying the first dipole excitation between pairs of rods.

4. The system of claim 1, wherein the first quadrupole Q0 ion guide further includes auxiliary electrodes placed between rods of the first quadrupole Q0 ion guide.

5. The system of claim 4, wherein the first quadrupole Q0 ion guide applies the first dipole excitation between rods or electrodes in the first quadrupole Q0 ion guide to excite to the continuous beam of ions by applying the first dipole excitation between pairs of the auxiliary electrodes.

6. The system of claim 4, wherein the processor removes ions in a region of the second precursor ion in the first quadrupole Q0 ion guide before selecting and fragmenting the first precursor ion in the first quadrupole Q0 ion guide by calculating one or more second excitation parameters that define a second dipole excitation that removes ions at a location of the second precursor ion, and applying the second dipole excitation between rods or electrodes in the first quadrupole Q0 ion guide to excite the continuous beam of ions before the first dipole excitation by additionally sending a second set of data including the second excitation parameters to the mass spectrometer so that the first quadrupole Q0 ion guide applies the second dipole excitation between rods or electrodes in the first quadrupole Q0 ion guide to excite the continuous beam of ions before the first quadrupole Q0 ion guide applies the first dipole excitation between rods or electrodes in the first quadrupole Q0 ion guide to excite the continuous beam of ions.

7. The system of claim 6, wherein the auxiliary electrodes placed between rods of the first quadrupole Q0 ion guide are further segmented into a first set of electrodes that receive the continuous beam of ions from the ion source and a second set of electrodes located in series along the axis of the first quadrupole Q0 ion guide.

8. The system of claim 7, wherein the processor applies the second dipole excitation between rods or electrodes in the first quadrupole Q0 ion guide to excite the continuous beam of ions before the first dipole excitation by sending the second data set to the mass spectrometer so that the first quadrupole Q0 ion guide applies the second dipole excitation between rods or electrodes in the first quadrupole Q0 ion guide to excite the first set of electrodes using the second excitation parameters and the first quadrupole Q0 ion guide applies the first dipole excitation between rods or electrodes in the first quadrupole Q0 ion guide to excite the second set of electrodes using the first excitation parameters.

9. The system of claim 6, wherein the first quadrupole Q0 ion guide further includes entrance electrodes placed at an entrance end of the first quadrupole Q0 ion guide and an exit lens at an exit end of the first quadrupole Q0 ion guide.

10. The system of claim 9, wherein the processor applies the second dipole excitation between rods or electrodes in the first quadrupole Q0 ion guide to excite the continuous beam of ions before the first dipole excitation so that the mass spectrometer traps ions in the first quadrupole Q0 ion guide by applying a voltage potential on the entrance electrodes and the exit lens, applies the second dipole excitation between rods or electrodes in the first quadrupole Q0 ion guide to excite the trapped ions in the first quadrupole Q0 ion guide to remove ions in a region of the second precursor ion, applies the first dipole excitation between rods or electrodes in the first quadrupole Q0 ion guide to excite the trapped ions in the first quadrupole Q0 ion guide to select and fragment the first precursor ion, and lowers the voltage potential on the exit lens to transmit the trapped ions to the second quadrupole Q1.

11. A method for selecting and fragmenting a first precursor ion in a mass spectrometry/mass spectrometry/mass spectrometry ($MS^3$) experiment, comprising:

calculating one or more first excitation parameters that define a first dipole excitation that selects a first precursor ion and fragments the first precursor ion to produce a second precursor ion using a processor;

applying the first dipole excitation between rods or electrodes in the first quadrupole Q0 ion guide to excite the continuous beam of ions by sending a first set of data including the first excitation parameters to a mass spectrometer so that a first quadrupole Q0 ion guide applies the first dipole excitation between rods or electrodes in the first quadrupole to select and fragment the first precursor ion in the first quadrupole Q0 ion guide and to produce the second precursor ion in the first quadrupole Q0 ion guide, wherein the second precursor ion is a fragment ion of the first precursor ion using the processor, wherein the mass spectrometer includes an ion source that provides the continuous beam of ions and the first quadrupole Q0 ion guide that receives the continuous beam of ions and is adapted to apply dipole excitation between rods or electrodes in the first quadrupole Q0 ion guide to excite the continuous beam of ions;

mass selecting the second precursor ion in a second quadrupole Q1;

accelerating the second precursor ion to a third quadrupole Q2 for high energy collision induced dissociation (CID); and removing ions in a region of the second precursor ion in the first quadrupole Q0 ion guide before selecting and fragmenting the first precursor ion in the first quadrupole Q0 ion guide using the processor.

12. The method of claim 11, wherein the first quadrupole Q0 ion guide applies the first dipole excitation between rods or electrodes in the first quadrupole Q0 ion guide to excite the continuous beam of ions by applying the first dipole excitation between pairs of rods.

13. The method of claim 11, wherein the first quadrupole Q0 ion guide further includes auxiliary electrodes placed between rods of the first quadrupole Q0 ion guide.

14. The method of claim 13, wherein the first quadrupole Q0 ion guide applies the first dipole excitation between rods or electrodes in the first quadrupole Q0 ion guide to excite the continuous beam of ions by applying the first dipole excitation between pairs of the auxiliary electrodes.

15. The method of claim 13, wherein the removing step is performed by calculating one or more second excitation parameters that define a second dipole excitation that removes ions at a location of the second precursor ion, and applying the second dipole excitation between rods or electrodes in the first quadrupole Q0 ion guide to excite the continuous beam of ions before the first dipole excitation by additionally sending a second set of data including the second excitation parameters to the mass spectrometer so that the first quadrupole Q0 ion guide applies the second dipole excitation between rods or electrodes in the first quadrupole Q0 ion guide to excite the continuous beam of ions before the first quadrupole Q0 ion guide applies the first dipole excitation between rods or electrodes in the first quadrupole Q0 ion guide to excite the continuous beam of ions while passing through the first quadrupole Q0 ion guide.

16. The method of claim 15, wherein the auxiliary electrodes placed between rods of the first quadrupole Q0 ion guide are further segmented into a first set of electrodes that receive the continuous beam of ions from the ion source and a second set of electrodes located in series along the axis of the first quadrupole Q0 ion guide.

17. The method of claim 16, wherein applying the second dipole excitation between rods or electrodes in the first quadrupole Q0 ion guide to excite the continuous beam of ions before the first dipole excitation comprises sending the second data set to the mass spectrometer using the processor so that the first quadrupole Q0 ion guide applies the second dipole excitation between rods or electrodes in the first quadrupole Q0 ion guide to excite the first set of electrodes using the second excitation parameters and the first quadrupole Q0 ion guide applies the first dipole excitation between rods or electrodes in the first quadrupole Q0 ion guide to excite the second set of electrodes using the first excitation parameters.

18. The method of claim 15, wherein the first quadrupole Q0 ion guide further includes entrance electrodes placed at an entrance end of the first quadrupole Q0 ion guide and an exit lens at an exit end of the first quadrupole Q0 ion guide.

19. The method of claim 18, wherein applying the second dipole excitation between rods or electrodes in the first quadrupole Q0 ion guide to excite the continuous beam of ions before the first dipole excitation comprises sending the second data set to the mass spectrometer using the processor so that the mass spectrometer traps ions in the first quadrupole Q0 ion guide by applying a voltage potential on the entrance electrodes and the exit lens, applies the second dipole excitation between rods or electrodes in the first quadrupole Q0 ion guide to excite the trapped ions in the first quadrupole Q0 ion guide to remove ions in a region of the second precursor ion, applies the first dipole excitation between rods or electrodes in the first quadrupole Q0 ion guide to excite the trapped ions in the first quadrupole Q0 ion guide to select and fragment the first precursor ion, and lowers the voltage potential on the exit lens to transmit the trapped ions to the second quadrupole Q1.

20. A computer program product, comprising a non-transitory and tangible computer-readable storage medium whose contents include a program with instructions being executed on a processor so as to perform a method for selecting and fragmenting a first precursor ion in a mass spectrometry/mass spectrometry/mass spectrometry ($MS^3$) experiment, comprising:

providing a system, wherein the system comprises one or more distinct software modules, and wherein the distinct software modules comprise an analysis module and a control module;

calculating one or more first excitation parameters that define a first dipole excitation that selects a first precursor ion and fragments the first precursor ion to produce a second precursor ion using the analysis module;

applying the first dipole excitation between rods or electrodes in the first quadrupole Q0 ion guide to excite the continuous beam of ions by sending a first set of data including the first excitation parameters to a mass spectrometer so that a first quadrupole Q0 ion guide applies the first dipole excitation between rods or electrodes in the first quadrupole Q0 ion guide to select and fragment the first precursor ion in the first quadrupole and to produce the second precursor ion in the first quadrupole Q0 ion guide, wherein the second precursor ion is a fragment ion of the first precursor ion using the control module, wherein the mass spectrometer includes an ion source that provides the continuous beam of ions and the first quadrupole Q0 ion guide that receives the continuous beam of ions and is adapted to apply dipole excitation between rods or electrodes in the first quadrupole Q0 ion guide to excite the continuous beam of ions while passing through the first quadrupole Q0 ion guide;

mass selecting the second precursor ion in a second quadrupole Q1;

accelerating the second precursor ion to a third quadrupole Q2 for high energy collision induced dissociation (CID); and removing ions in a region of the second precursor ion in the first quadrupole Q0 ion guide before selecting and fragmenting the first precursor ion in the first quadrupole Q0 ion guide.

* * * * *